United States Patent [19]

McCloud

[11] Patent Number: 5,072,880

[45] Date of Patent: Dec. 17, 1991

[54] SECTIONAL ROD BEARING FOR FUSSBALL GAME STRUCTURE

[76] Inventor: Calvin E. McCloud, 4959 Rendon Rd., Fort Worth, Tex. 76140

[21] Appl. No.: 634,392

[22] Filed: Dec. 27, 1990

[51] Int. Cl.[5] ..... A63F 7/06; A63F 7/36

[52] U.S. Cl. ..... 273/85 D; 384/273; 403/195

[58] Field of Search ..... 273/85 C, 85 D; 384/125, 273, 276, 297; 403/195, 197, 201; 411/383, 385

[56] References Cited

U.S. PATENT DOCUMENTS

| | | | |
|---|---|---|---|
| 2,675,283 | 4/1954 | Thomson | 384/299 |
| 2,832,596 | 4/1958 | Brown | 273/85 D |
| 4,382,598 | 5/1983 | McCloud | 273/85 D |
| 4,780,019 | 10/1988 | Johnson et al. | 29/525.1 X |

FOREIGN PATENT DOCUMENTS

| | | | |
|---|---|---|---|
| 69521 | 7/1949 | Denmark | 273/85 D |
| 899884 | 7/1949 | Denmark | 403/195 |
| 1012694 | 7/1952 | France | 273/85 D |
| 1032209 | 6/1953 | France | 273/85 D |
| 1036018 | 9/1953 | France | 273/85 D |
| 2230164 | 12/1974 | France | 273/85 D |
| 500168 | 11/1954 | Italy | 273/85 D |
| 500761 | 11/1954 | Italy | 273/85 D |
| 503033 | 12/1954 | Italy | 273/85 D |
| 724921 | 11/1966 | Italy | 273/85 D |
| 356393 | 9/1961 | Switzerland | 273/85 D |
| 424582 | 5/1967 | Switzerland | 273/85 D |

*Primary Examiner*—Edward M. Coven
*Assistant Examiner*—Sebastiano Passaniti
*Attorney, Agent, or Firm*—Johnson & Gibbs

[57] ABSTRACT

An improved bearing structure for a rod which permits both rotational and axial movement of the rod in conjunction with longitudinal bending thereof. Two semicylindrical pieces are assembled along an axial line of separation. A first cylindrical bearing half engages a second cylindrical bearing half integrally formed for matingly receiving the first half. The two halves of the bearing each include an outer, radially extending flange and are each passed through opposite sides of an aperture in a wall and are assembled into a complete bearing by threadably engaging one another within the wall aperture. The rod to be journaled is inserted through an axial opening formed through the bearing. Each semicylindrical bearing half is constructed with an expansion slot formed in an outer mounting flange for facilitating the flexure thereof during installation to prevent binding of the actuation rod therein.

18 Claims, 2 Drawing Sheets

SECTIONAL ROD BEARING FOR FUSSBALL GAME STRUCTURE

BACKGROUND OF THE INVENTION

1. Field of the Invention

The invention relates to improved rod bearings, and, more particularly, to an improved, sectional rod bearing for journaling a playing figure actuation rod in a fussball game table.

2. History of the Prior Art

This invention is directed to a bearing member for a fussball (also known as table soccer) game table generally of the type shown in U.S. Pat. No. 3,926,432. Typically, fussball game tables include a rectangular, box-like playing area supported on four legs. A plurality of axially slidable and rotatable rods are mounted on bearings and extend transversely of the playing area. The actuation rods each mount a plurality of playing figures which are arranged above the playing surface of the table in preselected formations. A light ball is placed on the playing surface and propelled by sharply rotating the actuating rods within their respective bearings, so that the foot of the playing figure strikes the ball and propels it along the playing surface toward one of the two goals located at opposite end walls of the table.

The rod bearings on prior art fussball tables are generally the most difficult portions of the table to service and maintain. In operation in a vending machine environment, the playing figure actuation rods gather dust from the environment and dirt and other soil from handling during operation. Because the actuation rods are continually being rapidly moved in an axial manner back and forth within the rod bearings dirt, debris and other matter deposited on the rods is scraped therefrom by the edges of the bearings. Consequently, the rod bearings must be removed and the bearing surfaces cleaned frequently to ensure smooth, rapid operation of the playing figure actuation rods.

Certain techniques for minimizing the maintenance required for fussball table rod bearings have been utilized in the past. For example, rod bearings have been constructed to include a circumferentially extending channel around the outside of the bearing so as to define a knife edge trough contiguous to the rod receiving aperture. This knife edge is intended to shave foreign material from the rod and collects it in the trough as the rod is slid back and forth within the bearing. This structure is intended to simplify maintenance by enabling one to merely clean the troughs periodically and avoid the time consuming removal of the bearings from the machine in order to effectuate cleaning. However, such bearing structures leave much to be desired in that a great deal of foreign matter is still collected on the interior bearing surface and may result in binding of the rods unless the bearings are periodically removed and the interior bearing surfaces thoroughly cleaned.

Prior art separable rod bearing structures overcome some of the maintenance difficulties such as ease of removal for cleaning. However, major problems are still present. For example, a rod moving in certain prior art bearings must be lubricated frequently in order to maintain as low friction as possible. In addition, the lubricant, typically a silicone spray material, builds up deposits on the rod which must be removed. The lubricant also attracts and holds dust and dirt to the rod further complicating rod bearing maintenance.

One solution to this prior art problem is set forth and shown in U.S. Pat. No. 4,382,598, invented by the applicant of the present invention. The structure of the separable rod bearing of that invention includes two semi-cylindrical pieces assembled with an anti-friction ring that virtually eliminates a need for lubricant. That design did not overcome all of the problems of prior art bearings, however. For example, one entire friction insert was made of teflon and although initially effective once this material becomes impregnated with debris from the rod it becomes just as abrasive as conventional material. In addition, material such as teflon have been deemed cost prohibitive in certain applications.

It would be an advantage to overcome the disadvantages of the prior art by providing a sectional rod bearing similar to that shown in U.S. Pat. No. 4,382,598 but without the need for an anti-friction ring and one that affords flexibility in adjustment and reliability in installation for maintaining the axial alignment of the aperture therethrough for receipt of the rod therein. Certain prior art structures such as that shown in the aforesaid U.S. Pat. No. 4,382,598 manifest a degree of warp upon the torquing of the various elements together through the fussball table wall. This axial misalignment occurs due to the pressures being applied to the outer flange of the sectional rod bearing that is not otherwise accommodated within the flange region. The unrelieved stresses produced during the torquing thereof may manifest themselves through the axial aperture to therein bind upon the rod. Any binding of the fussball rod reduces the efficiency of the game table and the actuation thereof.

It would be a distinct advantage to provide a sectional rod bearing structure which accommodates axial misalignment through means associated with the flange portion thereof for preventing binding of the rod therein. The present invention provides such a configuration by providing slotted sections in the flange region which slotted sections accommodate flexing of the flange upon the tightening thereof. Likewise, the anti-friction ring is eliminated and a material such as Delron is used for the fabrication of the entire rod bearing assembly.

SUMMARY OF THE INVENTION

The invention relates to an improved bearing structure for an actuation rod of a table soccer game. More particularly, the table soccer game structure is of the type having a playing field portion surrounded by raised opposite side walls and raised end walls wherein a plurality of actuating rods extend through apertures in opposite side walls. The rods are spaced transversely of and above the playing field and support game figures secured on the rods. The game figures are adapted to contact a ball disposed on the field. The actuating rods are rotatively and axially movable relative to the side walls.

The improvement includes a rod bearing comprising a first bearing half having an outer sleeve portion snugly received into one of the apertures in the table wall. The sleeve portion has an inner threaded cylindrical wall for receiving a second bearing half, and a radially extending flange for engaging the outer side wall adjacent the aperture. The flange includes a circular clearance aperture for receiving a playing rod coaxially through the bearing half.

A second bearing half includes an outer cylindrical threaded portion for engaging the threaded inner wall of the first bearing half, an outer sleeve portion received into one of the apertures in the table wall and separated from the threaded portion by a stepped region, and a radially extending flange for engaging the inner side wall adjacent the aperture. The flange includes a clearance aperture for receiving a playing rod coaxially through the bearing half.

The second bearing half is separable along opposed axial parting lines into two identical halves, each such half being constructed with a slotted portion which extends from the outer flange through the central insert region and partially into the rod support region. The slotted portion allows a degree of flexibility within the flange section sufficient to compensate for any adjustment necessary during installation, which adjustment can be accommodated without effecting the concentricity or axial alignment of the aperture therethrough.

In another aspect, the invention includes a rod bearing for a fussball game table playing figure actuation rod comprising a pair of coaxial bearing halves. Each bearing half includes a cylindrical outer sleeve portion for engaging the inner wall of a rod opening through a game table wall, and radial flanges for engaging the table walls adjacent the opening. The flanges each have clearance holes for receiving a rod extending coaxially through the bearing. The halves each have mating threaded portions for assembly of the two halves from opposite sides of a rod opening in a game table wall. One of the halves is separable into identical hemicylindrical portions along opposed, axial parting lines. The hemicylindrical portions of the bearing half may also include interfitting axial alignment means along the parting lines thereof axially align the thread on each of the two portions for engagement with the other bearing half.

Moreover, the hemicylindrical portions of the bearing half may also include slotted regions adapted for accommodating flexing of surface regions thereof during the installation through the table walls to thereby maintain the concentricity of the central aperture relative to the rod received therethrough. Additionally, when operatively fitted together, these hemicylindrical portions form an integral rod-engaging bearing surface, thereby eliminating the previous necessity of providing a separate insert member to slidably engage and support the rod within the bearing structure.

BRIEF DESCRIPTION OF THE DRAWINGS

For a more complete understanding of the invention, and for further objects and advantages thereof, references may be now had to the following description taken in conjunction with the accompanying drawings in which.

DETAILED DESCRIPTION

Figure 1:
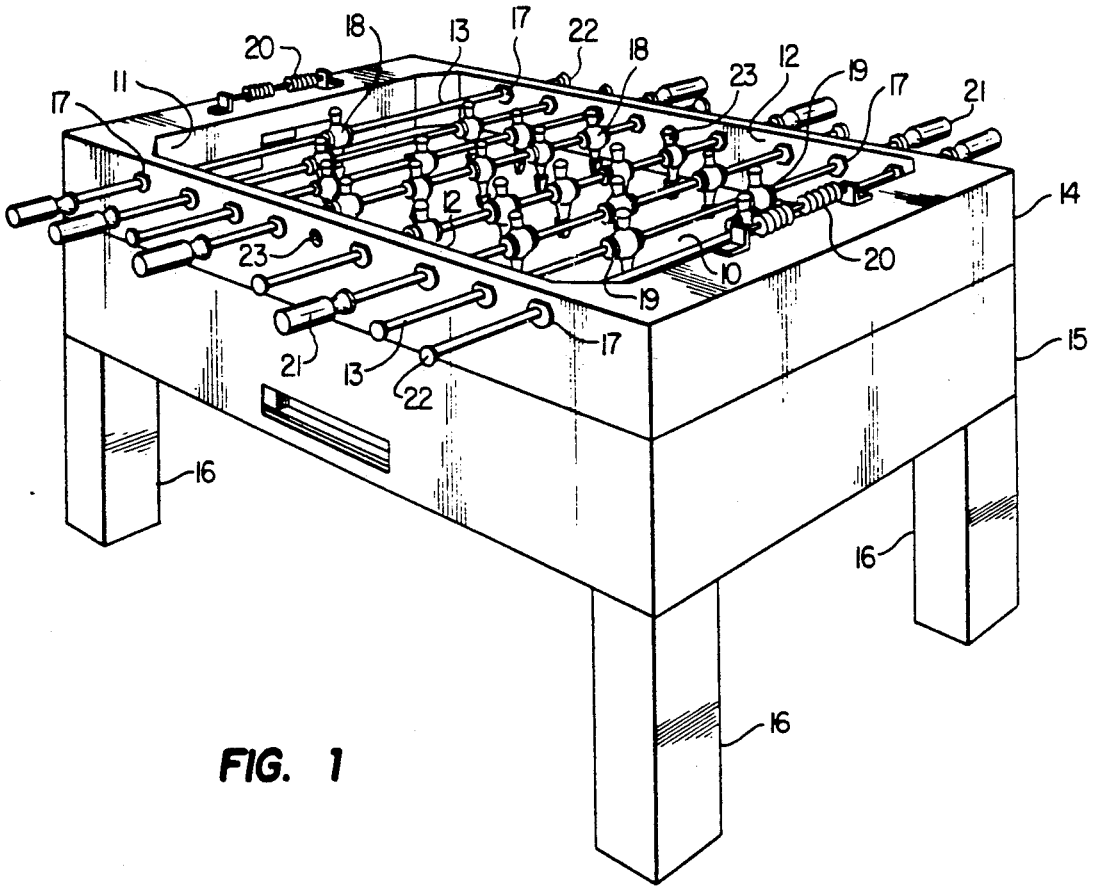
FIG. 1 is a perspective view of a fussball game table incorporating the improved bearing of the present invention.

Referring first to FIG. 1, the game table, within which the bearing of the present invention may be used, includes a playing surface 10 and vertically extending end and side walls 11 and 12, respectively. A plurality of transversely disposed playing figure actuation rods 13 are rotatably mounted and axially slidable in opposite side walls 12. The playing surface 10 and the vertically extending end and side walls 11 and 12 comprise a top housing unit 14. The top unit 14 is hinged along the back edge to a lower housing unit 15 which is supported upon four vertically extending rectangular legs 16.

The actuating rods 13 are rotatable and slidably supported in a plurality of pairs of bearings 17, located in each side wall, through which the actuating rods 13 pass. The bearings 17 are received into clearance apertures passing through the opposed longitudinal side walls 12 in each position in which an actuating rod is to pass. Each actuating rod 13 rigidly mounts one or more game figures 18. Soft, shock absorbing rubber bushings 19 are mounted to the actuating rods 13 and located outside the outer-most game figures 18 on each rod. During vigorous playing the actuating rods 13 are quickly shifted axially and rotationally in the bearings 17 to move the figures carried thereby relative to the playing surface 10 and manipulate a playing ball (not shown) upon the playing surface 10. The rubber bushings 19 function as bumpers to prevent the game figures 18 from striking too hard against the inner sides of the walls 12. Each of the actuating rods 13 is affixed to a handle 21 at the playing end and terminated by a cap 22 at the opposite end. The upper housing 14 includes ball drop openings 23 passing through opposite side walls near the center of the playing surface 10 and score keepers 20 located on the tops of opposite ends.

Figure 2:
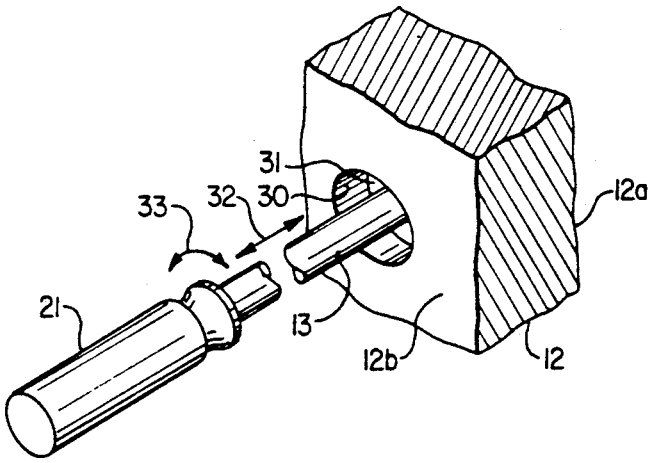
FIG. 2 (PRIOR ART)
FIG. 2 is a fragmentary perspective view of the outside of a prior art rod bearing structure.

Referring now to FIG. 2, there is shown a fragmentary perspective view of a prior art bearing and rod structure to aid in illustrating certain of the advantages of the bearing structure of the present invention. As mentioned above, the playing figure actuation rods 13 pass through the side walls of the table 12 by means of enlarged clearance holes 30. The prior art bearing members 31 include a flange (not shown) which is mounted against the inside surface of the side wall 12. The handle 21 enables manipulation of the playing figure actuation rod 13 in both the axially slidable direction as well as the rotational direction as indicated by arrows 32 and 33, respectively.

An improved rod bearing structure is shown in U.S. Pat. No. 4,382,598, wherein the rod bearing provides additional support to the rod. It also provides numerous advantages through its segmented construction. The configuration of the various segmented bearing member shown in such patent is not dramatically dissimilar to that of the present invention except for the fact that a well defined expansion slot is not provided therein, and an internal recess is provided for a friction member-a separate component advantageously eliminated in the bearing of the present invention.

Figure 3:
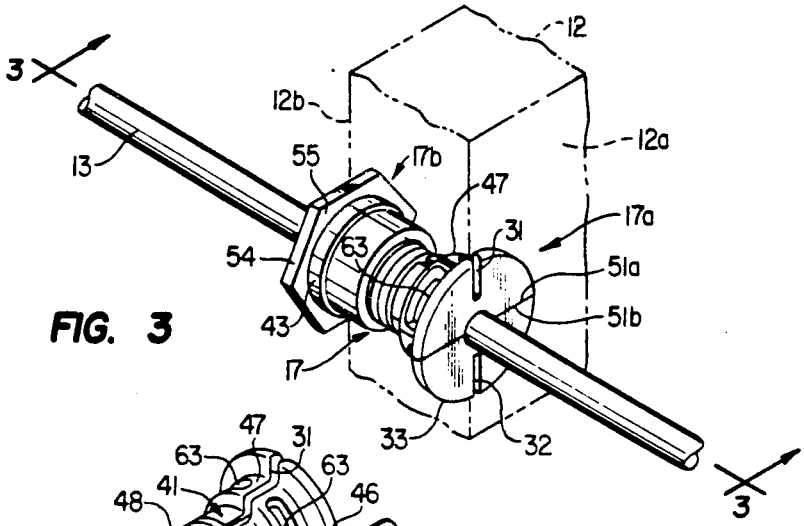
FIG. 3 is an enlarged, perspective view of the bearing structure of the present invention.

Referring now to FIG. 3 there is shown an enlarged perspective view of the bearing 17 of the present invention shown assembled in a fragmentary portion of a side wall 12 of a fussball table structure. The bearing 17 is shown to be constructed with a pair of diametrically opposed, radially extending expansion slots 31 and 32 that facilitate the flexing of a circular outer flange portion 33 thereof during installation of the segmented bearing structure. As described in more detail below, the expansion slots 31 and 32 permit the full assembly of the segmented bearing structure 17 without degradation of the concentricity or axial alignment of the rod receiving aperture therethrough.

Figure 4:
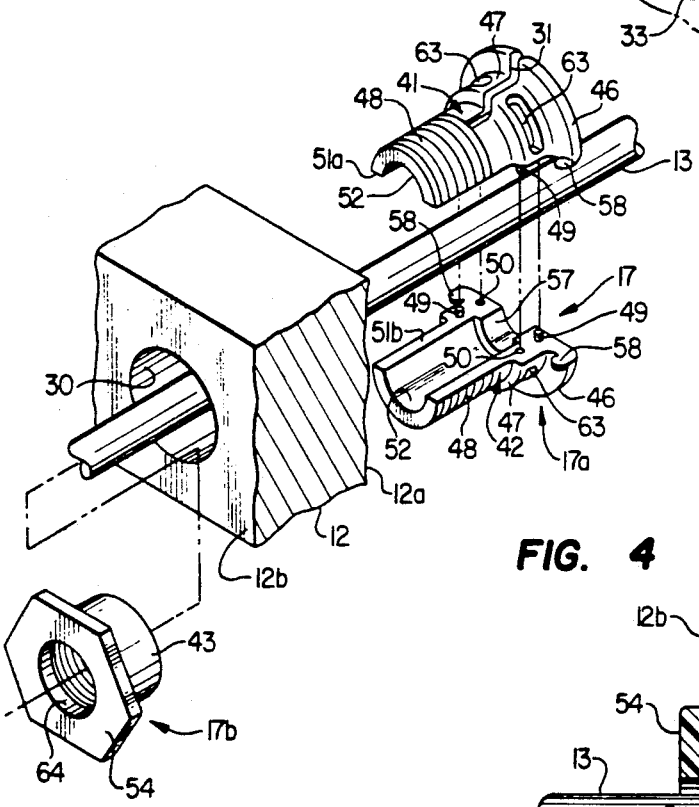
FIG. 4 is a fragmentary exploded view of the bearing of the present invention and illustrates its appearance when disassembled into its component portions.

Referring now to FIG. 4, there is shown an exploded view of the improved bearing 17 of the invention. The bearing 17 comprises three separate, individual pieces. A male half $17_a$ of the bearing 17 is comprised of two identical, hemicylindrical pieces 41 and 42 fitted together. The female half $17_b$ of the bearing is comprised of an integrally formed single cylindrical piece 43.

Still referring to FIG. 4, each of the two pieces 41 and 42 comprising the male half of the bearing includes a semicylindrical outer flange portion 46, the two flange halves 46 combinatively defining the circular flange 33. The flange 33 overlies the inner side surface $12_a$ of the side wall 12. A semicylindrical body portion 47 is provided in a size approximately the same diameter as the inner diameter of the clearance hole 30. Extending forwardly (i.e., leftwardly) from the semi-cylindrical section 47 is an externally threaded semi-cylindrical portion 48 which forms a male threaded portion of one-half of the bearing.

The two portions of the male half $17_a$ of the bearing 17 are radially separable along flat, axially extending mating surfaces $51_a$, $51_b$ defining the line of separation between the two portions. Formed on the facing surfaces $51_a$, $51_b$ are opposed circular pins 49 and circular openings 50 which, when the surfaces $51_a$, $51_b$ are pressed together, interlock to axially align the portions 41, 42 of the male half $17_a$ of the segmented bearing structure 17. The two halves 4, 42 are identical to one another so that when the halves are interlocked together their two semicircular side recesses 52 form a cylindrical chamber 53 (FIG. 5) for receiving the rod 13 therein. The interlocking pins 49 and openings 50 serve to align the molded external threads 48 such that the ridge and valley pattern of each of two halves 41, 42 will axially align with one another to form a continuous external spiral screw thread on the male bearing section $17_a$.

The female half $17_b$ of the bearing is comprised of a single portion 43, including a radially outwardly extending flange portion 54 which overlies the outer side surface $12_b$ of the wall 12, and a cylindrical inner portion 55 (FIG. 5) which is snugly received in the clearance hole 30. The inside wall of the portion 43 includes screw threads 56 (FIG. 5) which forms a continuous spiral screw thread for reception of the male screw threads 48 on the other half of the bearing.

Figure 5:
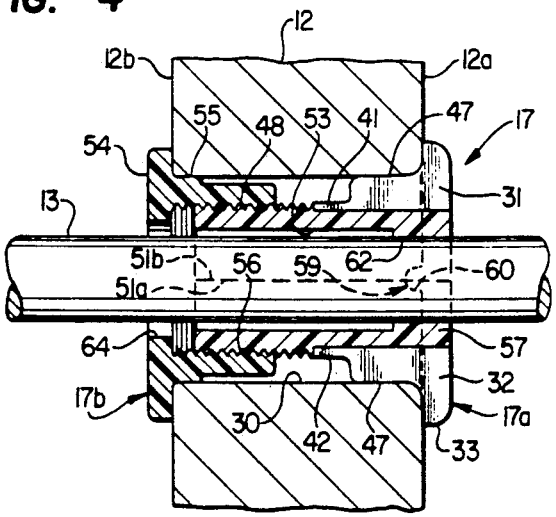
FIG. 5 is an enlarged scale cross-sectional view through the rod bearing structure of the present invention taken along line 5—5 of FIG. 3.

To assemble the bearing, he two male portions of the bearing 41 and 42 are brought together and form the male half $17_a$ for securement to the portion 43 of the female half **17*b* of the bearing. The assembled male portion $17_a$ is then inserted into the wall opening 30. As best illustrated in FIGS. 4 and 5, each of the flange portions 46 has formed thereon two small, leftwardly extending, diametrically opposite projections 58. When the two male halves 41, 42 are assembled, and interlocked by the alignment means 49 and 50, the male bearing portion $17_a$ is inserted into the right end of the wall opening 30 (as shown in FIG. 5) in a manner such that the flange 33 is brought flush against the inner side surface $12_a$ of wall 12 and a pair of hemispherical stops 59 (each defined by an adjacent pair of the projections 58) are received in a pair of openings 60 formed in the inner wall surface $12_a$ to preclude rotation of the male portion $17_a$ relative to wall 12. Next, while holding flange 33 against wall surface $12_a$, the female bearing portion is inserted into the left end of wall opening 30, threaded onto the male threads 48, and rotationally tightened to draw the flanges 33, 54** tightly against the wall surfaces $12_a$, $12_b$.

The playing figure actuation rod 13 as shown herein may be the subject of particularly vigorous playing periods. The actuating handles may be moved about by a player and downwardly leaned on such that the rod may be deflected downwardly outside of the table. Unrestrained deflection of the actuation rods 13 to this extent may result in a permanent deformation of the metal such that the rod is bent. Once bent, actuation rods are very difficult to straighten and of considerable expense to replace. The present invention does, however, facilitate this replacement.

As can be seen, the improved bearing structure of the present invention is very simple to totally disassemble. By merely unscrewing the male and female portions $17_a$ and $17_b$, each can be withdrawn from within the clearance hole 30. Bearing 17 may be further disassembled by radially separating the two male portion halves 41 and 42 to expose an integral bearing ring 57 therein to permit easy and rapid cleaning thereof. As illustrated in FIG. 5, this integral bearing ring 57 is defined by a radially inwardly thickened right end portion of passage 53, and has a circular inner side surface 62.

Further, the improved bearing of the present invention is very simple to manufacture in that only two distinct parts are required for the three part bearing. Since each of the two parts 41 and 42 comprising the male halves of the bearing are identical with one another, the manufacture and stocking of parts, and the readiness of interfitting, are greatly facilitated. The parts are preferably formed by injection molding from plastic.

Referring now to FIG. 5, there is shown an enlarged side elevational, cross-sectional view of the bearing 17 of the present invention illustrated with an actuation rod 13 as shown and disposed therethrough. The bearing 17 is in its assembled position relative to the wall 12 of the fussball table structure and the radially slotted regions 31 and 32 are clearly illustrated therein. This slotted portion, as stated above, affords deflection of flange 33 relative to the tightening of the bearing member sections that sandwich the fussball table wall 12 therebetween. This flexing permits the maintenance of the axial alignment of the rod 13 within the bearing aperture 30 as clearly shown in FIG. 5, in a manner which will now be described in conjunction with FIGS. 5 and 6.

Figure 6:
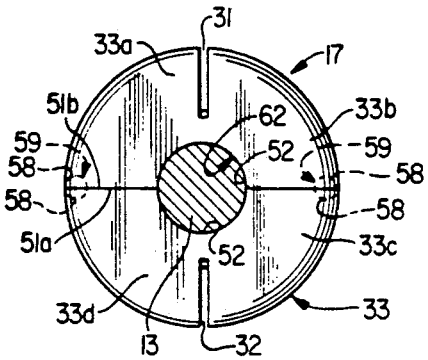
FIG. 6 is an enlarged scale right end view of the bearing structure of FIG. 3 illustrating the assembly thereof.

FIG. 6 is a right end elevational view of the bearing 17 of FIG. 5 illustrating the rod 13 extending outward therefrom as shown in cross-section. Each expansion slot 31 and 32 is shown to effectively segment the flange 33 into quadrants $33_a$-$33_d$, thereby facilitating the flexing thereof and the controlled deformation relative to the side wall 12 of the table without deleterious degradation of the concentricity of the wall aperture 30 and the circular interior surface of the integral rod supporting portion of the bearing structure.

Referring now to FIG. 5, it can be seen that a right or flange end portion of the segmented male bearing portion $17_a$ is, as previously mentioned, radially inwardly thickened to form in such male portion the integral rod support portion 57 having the circular interior surface 62 that slidably engages and supports the rod 13 for axial and rotational movement thereof relative to the wall 12. This circular rod support surface 62 is defined by facing, radially reduced right end portions of the previously mentioned semi-circular bearing segment recesses 52 (FIGS. 4 and 6).

As will be readily appreciated, it is highly desirable to maintain a very precise circularity of the rod support surface 62, while at the same time maintaining a precise concentricity between the circular surface 62 and the circular wall opening 30, to assure that rod 13 is precisely concentric with the wall opening 30 and is not subjected to undesirable binding forces arising from noncircularity of the bearing surface 62.

Due to the unavoidable tendency of plastic to experience at least some degree of warpage during post-molding cooling, these goals have proven difficult to achieve in previous plastic rod bearings-particularly in those of segmented design. The difficulty arises when external stresses are imposed on the bearing structure, such as when the bearing is tightened into its associated wall opening, and (due to molding warpage) are transferred to the critical rod engaging interior surface of the bearing in a manner cocking its axis and/or warping its intended circularity.

In previous plastic rod bearings, these problems proved severe enough that a common solution was to radially undersize the circular rod-engaging interior surface of the bearing, operatively install the bearing in its associated wall opening, and then laboriously ream out the rod-supporting circular bearing openings, to their final diameters, and restore their circularity and concentricity with their associated wall openings.

Due to unavoidable molding cooling warpage in the male bearing portion $17_a$ shown in FIG. 5, the bearing portion $17_a$ is subjected to the same external forces conventionally requiring that the surface 62 be reamed out before rod 13 is operatively installed therein. For example, it is quite likely that the outer side surfaces of the facing bearing segments 47 are somewhat out-of-round, and the flange portions 31, 32 are somewhat distorted. Accordingly, when the bearing portions 47 are forced into wall opening 30, and the flange 33 is drawn tightly against the wall surface $12_a$, the flange 33 is subjected to uneven axial forces, and the body portions 47 are subjected to uneven radial forces arising from the forcing of the outer-of-round body portions 47 into the precisely circular wall opening 30.

It is these unavoidably uneven forces which cause undesirable distortion and cooking of the circular rod-engaging surfaces in conventional plastic rod bearings, and the surface 62 would thus seem to be a likely candidate for reaming. However, the necessity of reaming the surface 62 is uniquely avoided in the present invention by the provision of the diametrically opposite slotted areas 31 and 32 in the male bearing halves 4 and 42.

As the bearing portions $17_a$, $17_b$ are tightened to one another as illustrated in FIG. 5, these slotted areas permit radially outer portions of the flange sections 46 and the body sections to flex in a manner compensating for the uneven tightening forces and essentially isolating the surface 62 from such uneven forces. Accordingly, the opposing halves of the surface 62 are drawn together to provide this critical surface area with precise circularity and concentricity with the axis of wall opening 30. Since the axis of the circular surface 62 is precisely concentric with wall opening 30, the rod portion disposed within opening 30 is also precisely concentric therewith. Thus, the desirable maintenance accessibility of the segmented bearing portion $17_a$ is provided without attendant problems with its rod engaging surface.

As previously mentioned, the uneven tightening forces compensated for by the slotted areas 31, 32 arise primarily from the cooling distortion in the molded bearing sections 41 and 42. In the present invention, this distortion is substantially reduced adjacent the critical surface area 62 by the provision in the body section 47 of circumferentially spaced external molding depressions 63 (FIGS. 3 and 4). These depressions serve to reduce the total mass and radial thickness of the body sections 47, thereby reducing the amount of cooling distortion therein which must be compensated for by the slotted areas 31 and 32.

As best illustrated in FIG. 5, the diameter of the circular opening 64 in the flange 54 is larger than the diameter of the actuating rod 13. The surface of opening 64 acts as a transverse stop for the rod 13 which abuttingly engages the rod upon transverse flexure of an outer end portion thereof to its elastic limit and supports the rod against plastic deformation.

It is thus believed that the operation and construction of the present invention will be apparent from the foregoing description. While the apparatus as shown and described has been characterized as being preferred it will be obvious that various changes and modifications may be made therein without departing from the spirit and scope of the invention as defined in the following claims.

What is claimed is:

1. An improved table soccer or fussball game structure of the type having a playing field portion surrounded by raised opposite side walls and raised end walls wherein a plurality of actuating rods extend through apertures in said opposite side walls and are spaced transversely of and above said playing field portion, said rods supporting game figures thereon which depend adjacent said playing field portion to contact a ball disposed thereon, said actuating rods being rotatively and axially movable relative to said side walls, and wherein the improvement includes a rod bearing mounting in each aperture in said side walls, said bearing comprising:

a first bearing half having an outer sleeve portion snugly received into one of the apertures in the table wall, said sleeve portion having an inner threaded cylindrical wall for receiving a second bearing half, and a radially extending first flange for engaging the outer side wall surface adjacent the wall aperture, said first flange including a circular clearance aperture for receiving an actuating rod coaxially through said first bearing half;

a second bearing half having an outer cylindrical threaded portion for engaging the threaded inner wall of the first bearing half, an outer sleeve portion received into one of the apertures in the table wall and separated from the threaded portion by a stepped region, and a radially extending second flange for engaging the inner side wall surface adjacent the wall aperture, said second flange having an integral, concentric aperture extending therethrough for receiving an actuating rod coaxially through said second bearing half, said second bearing half being separable along opposed axial parting lines into two identical halves; and said second flange further including first and second axially extending slot portions, formed only through radially outer portions thereof, for permitting the flexing thereof relative to the concentric aperture therein to facilitate the mounting thereof, and the operative tightening of said second bearing half to said first bearing half within said one of the apertures in the table wall, without transmitting an appreciable amount of tightening distortion force to the periphery of said concentric aperture of said second bearing half.

2. The improved game structure as set forth in claim 1 wherein the identical halves of said second bearing half include cooperative, interengageable alignment means thereon for operatively aligning said identical halves and holding the threaded portions thereof in operative registry during engagement with the first bearing half.

3. The game structure as set forth in claim 1 wherein the circular clearance aperture in the flange of the first bearing half is sized to abuttingly engage the rod upon transverse flexure of the outer end of the rod to its elastic limit and support the rod against plastic deformation.

4. The game structure as set forth in claim 1 wherein the outer sleeve portions of both bearing halves are cylindrical for reception into circular apertures in the game table walls.

5. The game structure as set forth in claim 1 wherein said identical halves of said second bearing half have integral facing portions which combinatively define an integral bearing ring having a circular interior side surface adapted to engage and slidably support a longitudinal portion of an actuating rod.

6. The game structure as set forth in claim 1 wherein said second flange has formed thereon an axially inwardly directed projection adapted to be received in an opening in the inner side wall surface and operative to inhibit rotation of said second flange relative to said side wall.

7. An improved molded plastic bearing structure insertable into a side wall opening of a table soccer or fussball game structure and operative to slidably support an actuating rod, coaxially extending through said side wall opening, for axial and rotational movement relative to the side wall, said improved molded plastic bearing structure comprising:

first and second hollow cylindrical sections axially insertable into said side wall opening, from opposite sides thereof, and being threadingly engageable with one another, each of said sections having a body portion snugly receivable within said side wall opening, and an outer end flange abuttable with a side surface of the wall when said first and second sections are threadingly tightened to one another within said side wall opening, said first section being formed from two separable radial halves which combinatively define, along an interior surface portion of said first section longitudinally adjacent said body portion and outer end flange thereof, an integral circular rod-engaging surface for slidably contacting and supporting a longitudinal portion of said actuating rod, said outer end flange and body portion of said first section, due to molding distortion therein, being subjectable to unevenly distributed exterior surface wall contact forces when said first and second sections are operatively tightened together within said side wall opening; and stress relieving means, formed on only a radially outer portion of said first section positioned radially outwardly of said circular rod-engaging surface, for isolating said circular rod-engaging surface from unevenly distributed wall contact forces to preserve the circularity of said rod-engaging surface and maintain it in a precisely concentric relationship with said side wall opening.

8. The improved molded plastic bearing structure of claim 7 wherein:

said first section is threadable into said second section.

9. The improved molded plastic bearing structure of claim 7 wherein:

said first section is hollow and generally bolt-shaped, and said second section is generally nut-shaped.

10. The improved molded plastic bearing structure of claim 7 further comprising:

at least one axial projection formed on said outer end flange of said first section and receivable in a corresponding opening in said side wall to inhibit rotation of said first section relative to said side wall.

11. The improved molded plastic bearing structure of claim 7 further comprising:

cooperatively interengageable alignment means formed on said radial halves of said first section for releasably holding them in an operatively aligned relationship.

12. The improved molded plastic bearing structure of claim 7 wherein:

said outer end flange of said second section has a central opening therein, the surface of which outwardly circumscribes the bearing-installed actuating rod and acts as a transverse abutment therefor in response to a transverse deflection of the actuating rod.

13. The improved molded plastic bearing structure of claim 7 wherein said stress relieving means include:

radially inwardly extending slot means formed in said outer end flange of said first section and operative to permit flexure thereof during tightening together of said first and second sections within said side wall opening.

14. The improved molded plastic bearing structure of claim 13 wherein:

said slot means extend axially across an external side surface portion of said body portion of said first section.

15. The improved molded plastic bearing structure of claim 7 further comprising:

a circumferentially spaced series of relatively deep exterior surface depressions formed on said body portion of said first section.

16. An improved molded plastic bearing structure insertable into a side wall opening of a table soccer or fussball game structure and operative to slidably support an actuating rod, coaxially extending through said side wall opening, for axial and rotational movement relative to the side wall, said improved molded plastic bearing structure comprising:

first and second hollow cylindrical sections axially insertable into said side wall opening, from opposite sides thereof, and being threadingly engageable with one another, each of said sections having a body portion snugly receivable within said side wall opening, and an outer end flange abuttable with a side surface of the wall when said first and second sections are threadingly tightened to one another within said wall opening.

said first section being formed from two separable radial halves which combinatively define, along an interior surface portion of said first section longitudinally adjacent said body portion and outer end flange thereof, an integral circular rod-engaging surface for slidably contacting and supporting a longitudinal portion of said actuating rod, said outer end flange and body portion of said first section, due to molding distortion therein, being subjectable to unevenly distributed exterior surface wall contact forces when said first and second sections are operatively tightened together within said side wall opening; and stress relieving means, formed on a radially outer portion of said first section, for isolating said circular rod-engaging surface from unevenly distributed wall contact forces to preserve the circularity of aid rod-engaging surface and maintain it in a precisely concentric relationship with said side wall opening, said stress relieving means including:

radially inwardly extending slot means formed in said outer end flange of said first section and operative to permit flexure thereof during tightening together of said first and second sections within said side wall opening, said slot means including a diametrically opposed pair of slots extending radially inwardly through the outer edge periphery of said outer end flange of said first section.

17. The improved molded plastic bearing structure of claim 16 wherein:

said opposed pair of slots axially extend across diametrically opposite exterior surface portions of said body portion of said first section.

18. The improved molded plastic bearing structure of claim 17 wherein:

said radial halves of said first section meet along a surface area lying generally in a first plane, and said diametrically opposed pair of slots are disposed in a second plane generally perpendicular to said plane.

* * * * *